US011357277B2

(12) United States Patent
Inzer

(10) Patent No.: US 11,357,277 B2
(45) **Date of Patent: *Jun. 14, 2022**

(54) SUPPORT SHIRT WITH SLEEVE REINFORCEMENT REGIONS

(71) Applicant: John Inzer, Longview, TX (US)

(72) Inventor: John Inzer, Longview, TX (US)

(73) Assignee: INZER ADVANCE DESIGNS, INC., Longview, TX (US)

( * ) Notice: Subject to any disclaimer, the term of this patent is extended or adjusted under 35 U.S.C. 154(b) by 98 days.

This patent is subject to a terminal disclaimer.

(21) Appl. No.: 16/910,158

(22) Filed: Jun. 24, 2020

(65) Prior Publication Data

US 2020/0323291 A1 Oct. 15, 2020

Related U.S. Application Data

(63) Continuation of application No. 14/657,237, filed on Mar. 13, 2015, now Pat. No. 10,729,187, which is a (Continued)

(51) Int. Cl.
*A41B 1/08* (2006.01)
*A41D 27/06* (2006.01)
(Continued)

(52) U.S. Cl.
CPC ..... *A41D 31/18* (2019.02); *A41B 1/08* (2013.01); *A41D 13/0002* (2013.01); *A41D 13/0015* (2013.01); *A41D 27/06* (2013.01); *A41D 27/10* (2013.01); *A63B 21/00181* (2013.01); *A63B 21/0552* (2013.01); *A63B 21/078* (2013.01); *A63B 21/4005* (2015.10); *A63B 21/4007* (2015.10); *A63B 21/4017* (2015.10); *A63B 21/4025* (2015.10); *A63B 69/0048* (2013.01); *A63B 69/06* (2013.01); *A63B 2069/068* (2013.01); *A63B 2225/30* (2013.01)

(58) Field of Classification Search
CPC ..... A41D 13/0002; A41D 13/0015; A41D 27/06; A41D 27/10; A41D 31/00; A41D 2300/22; A41B 1/00; A41B 1/08; A41B 1/20; A41B 1/22; A63B 21/00181; A63B 21/40; A63B 21/4005; A63B 21/4007; A63B 21/4017; A63B 21/4025; A63B 21/065
USPC ..... 2/77, 113, 115, 118, 121, 125, 255; 482/124
See application file for complete search history.

(56) References Cited

U.S. PATENT DOCUMENTS 2,035,377 A 3/1936 Redmond
2,164,036 A 6/1939 Lane
(Continued)

FOREIGN PATENT DOCUMENTS

AU 3710193 A 10/1993

*Primary Examiner* — Jameson D Collier
(74) *Attorney, Agent, or Firm* — Dinsmore & Shohl LLP

(57) ABSTRACT

A support shirt including a shirt body and a pair of shirt body sleeves positioned adjacent to an upper shirt body is provided. The sleeves are attached to the shirt body at sleeve body holes, with each of the sleeves including sleeve reinforcement regions extending at least a portion of the distance from the sleeve holes to an outer edge of the sleeves. The sleeve reinforcement regions extend substantially along a centerline extending longitudinally across the sleeves and the upper sleeve body to stabilize and provide support to the shoulders of a wearer during an upward lifting motion.

20 Claims, 10 Drawing Sheets

Related U.S. Application Data continuation-in-part of application No. 14/032,645, filed on Sep. 20, 2013, now abandoned.

(51) Int. Cl.

| | |
|---|---|
| ***A41D 27/10*** | (2006.01) |
| ***A41D 31/18*** | (2019.01) |
| ***A41D 13/00*** | (2006.01) |
| ***A63B 21/00*** | (2006.01) |
| *A63B 69/00* | (2006.01) |
| *A63B 21/078* | (2006.01) |
| *A63B 21/055* | (2006.01) |
| *A63B 69/06* | (2006.01) |

(56) References Cited

U.S. PATENT DOCUMENTS

| | | | |
|---|---|---|---|
| 2,309,601 | A | 1/1943 | Kneibler |
| 2,439,149 | A | 4/1948 | Smicker |
| 2,687,527 | A | 8/1954 | Rendino |
| 2,741,203 | A | 4/1956 | Rand |
| 2,871,849 | A | 2/1959 | Clark |
| 2,959,837 | A | 11/1960 | Jette |
| 3,066,418 | A | 12/1962 | Terry |
| 3,289,748 | A | 12/1966 | Jennings |
| 3,771,169 | A | 11/1973 | Edmund |
| 3,789,429 | A | 2/1974 | Garcia |
| 4,384,369 | A | 5/1983 | Prince |
| 4,473,908 | A | 10/1984 | Knecht |
| 4,547,904 | A | 10/1985 | Long et al. |
| 4,563,157 | A | 1/1986 | Hoshino |
| 5,046,194 | A | 9/1991 | Alaniz et al. |
| 5,097,535 | A | 3/1992 | Dye et al. |
| 5,359,731 | A | 11/1994 | Cavalier |
| 5,383,235 | A | 1/1995 | Peters |
| 5,392,466 | A | 2/1995 | Chou et al. |
| 5,431,030 | A | 7/1995 | Ishizaki et al. |
| 5,570,472 | A | 11/1996 | Dicker |
| 5,727,254 | A | 3/1998 | Dicker |
| 5,737,772 | A | 4/1998 | Dicker et al. |
| 5,737,773 | A | 4/1998 | Dicker et al. |
| 5,745,917 | A | 5/1998 | Dicker et al. |
| 5,778,452 | A | 7/1998 | Dicker et al. |
| 5,822,794 | A | 10/1998 | Allred |
| 5,829,058 | A | 11/1998 | Dicker et al. |
| 5,857,947 | A | 1/1999 | Dicker et al. |
| 5,937,442 | A | 8/1999 | Yamaguchi et al. |
| 5,957,878 | A | 9/1999 | Gilliam |
| 5,978,966 | A | 11/1999 | Dicker et al. |
| 5,991,923 | A | 11/1999 | Maria |
| 6,021,524 | A | 2/2000 | Wu et al. |
| 6,047,405 | A | 4/2000 | Wilkinson |
| 6,053,852 | A | 4/2000 | Wilkinson |
| 6,178,557 | B1 | 1/2001 | Bel Monte |
| 6,231,488 | B1 | 5/2001 | Dicker et al. |
| 6,263,510 | B1 | 7/2001 | Bay et al. |
| 6,301,717 | B1 | 10/2001 | Matsumoto et al. |
| 6,446,264 | B2 | 9/2002 | Fairhurst et al. |
| 6,675,389 | B1 | 1/2004 | Kublick |
| D498,037 | S | 11/2004 | Bay |
| 6,854,130 | B2 | 2/2005 | van der Sleesen |
| 6,892,396 | B2 | 5/2005 | Uno et al. |
| 7,111,328 | B2 | 9/2006 | Bay |
| D608,077 | S | 1/2010 | Bybee et al. |
| D618,440 | S | 6/2010 | Parker |
| D620,231 | S | 7/2010 | Parker |
| 7,752,681 | B2 | 7/2010 | Michel |
| 7,810,171 | B2 | 10/2010 | Moore |
| 7,886,367 | B2 | 2/2011 | Chapuis et al. |
| 7,941,871 | B1 | 5/2011 | Jorgensen |
| 8,001,618 | B2 | 8/2011 | Bay |
| D674,168 | S | 1/2013 | Kajino et al. |
| 8,533,864 | B1 | 9/2013 | Kostrzewski |
| 8,578,517 | B2 | 11/2013 | Alaniz et al. |
| D698,124 | S | 1/2014 | Yu et al. |
| 8,910,317 | B2 | 12/2014 | Decker |
| 2004/0016041 | A1 | 1/2004 | Uno et al. |
| 2005/0166298 | A1 | 8/2005 | Pieroranzio |
| 2005/0241044 | A1 | 11/2005 | Zorica |
| 2006/0053658 | A1 | 3/2006 | Voughlohn |
| 2006/0085889 | A1 | 4/2006 | Okajima |
| 2006/0230490 | A1 | 10/2006 | Okajima |
| 2006/0272069 | A1 | 12/2006 | Sheetz |
| 2006/0277653 | A1 | 12/2006 | Okajima |
| 2007/0000015 | A1 | 1/2007 | Alaniz et al. |
| 2007/0074328 | A1 | 4/2007 | Melhart et al. |
| 2008/0078008 | A1 | 4/2008 | Demarest et al. |
| 2008/0196136 | A1 | 8/2008 | Fellouhe et al. |
| 2009/0056870 | A1 | 3/2009 | Glenn |
| 2009/0077708 | A1 | 3/2009 | Takamato et al. |
| 2009/0100569 | A1 | 4/2009 | Butler |
| 2009/0113596 | A1 | 5/2009 | Young |
| 2009/0139005 | A1 | 6/2009 | Whaley |
| 2010/0043115 | A1 | 2/2010 | Weatherill et al. |
| 2010/0064415 | A1 | 3/2010 | Melhart et al. |
| 2010/0077527 | A1 | 4/2010 | Lee et al. |
| 2010/0125930 | A1 | 5/2010 | Burrell, IV |
| 2010/0138976 | A1 | 6/2010 | Appelbaum |
| 2010/0218300 | A1 | 9/2010 | Alaniz et al. |
| 2010/0242156 | A1 | 9/2010 | Calautti |
| 2010/0299798 | A1 | 12/2010 | Fayle et al. |
| 2011/0009793 | A1 | 1/2011 | Lucero et al. |
| 2011/0035859 | A1 | 2/2011 | Koga et al. |
| 2011/0083246 | A1 | 4/2011 | Vitarana |
| 2011/0167539 | A1 | 7/2011 | Tatsuno et al. |
| 2011/0185476 | A1 | 8/2011 | Boisseau et al. |
| 2011/0302686 | A1 | 12/2011 | Chapuis |
| 2012/0174285 | A1 | 7/2012 | Wiliams et al. |
| 2012/0204314 | A1 | 8/2012 | Pounds et al. |
| 2013/0067628 | A1 | 3/2013 | Harb |
| 2013/0160189 | A1 | 6/2013 | Yang |
| 2013/0167285 | A1 | 7/2013 | Decker |
| 2013/0237110 | A1 | 9/2013 | Morales |
| 2013/0298302 | A1 | 11/2013 | Whaley |
| 2013/0312154 | A1 | 11/2013 | Koga et al. |
| 2013/0318677 | A1 | 12/2013 | Liu |
| 2013/0326785 | A1 | 12/2013 | Cornacchiari et al. |
| 2014/0317826 | A1 | 10/2014 | Decker |
| 2014/0325732 | A1 | 11/2014 | Anderson |
| 2015/0020288 | A1 | 1/2015 | Picot |
| 2015/0082510 | A1 | 3/2015 | Inzer |
| 2015/0164148 | A1 | 6/2015 | Takamoto et al. |
| 2015/0189926 | A1 | 7/2015 | Bunting |
| 2015/0189927 | A1 | 7/2015 | Bunting |
| 2015/0196072 | A1 | 7/2015 | Inzer |
| 2016/0262460 | A1 | 9/2016 | Inzer |
| 2016/0262474 | A1 | 9/2016 | Inzer |
| 2016/0286872 | A1 | 10/2016 | Wilson |
| 2016/0286873 | A1 | 10/2016 | Knipp et al. |
| 2016/0345647 | A1 | 12/2016 | Ladaev |
| 2017/0027235 | A1 | 2/2017 | Inzer |
| 2017/0232290 | A1 | 8/2017 | Alaniz, III |

SUPPORT SHIRT WITH SLEEVE REINFORCEMENT REGIONS

CROSS-REFERENCE TO RELATED APPLICATIONS

This application is a continuation of U.S. application Ser. No. 14/657,237, filed Mar. 13, 2015, which is a continuation-in-part of U.S. application Ser. No. 14/032,645, filed Sep. 20, 2013. The entire contents of which are hereby incorporated by reference in their entirety including the drawings.

BACKGROUND

The subject matter described herein relates to a shirt or garment which covers the upper torso of a wearer. Specifically, embodiments are directed to a support shirt providing support along the chest and shoulder regions of the wearer. The support shirt can be used for a variety of sporting or work activities where support of the chest and shoulders is desired. One such application of the support shirt is a bench press shirt for support in weightlifting activities.

Bench press shirts provide an increase in the amount of weight a bench presser can lift as well as increased safety to the bench presser. Typically, bench press shirts are made of high strength materials, such as double knit polyester, canvas, or denim which are designed to fit the wearer tightly. Such bench press shirts have portions covering the upper arms and chest which typically provide a taut fit during lifting. Bench press shirts can also be made of spandex type fabric and be effective for support. As distinguished from ordinary shirts or t-shirts, bench press shirts have at least one area of increased support/strength, designed to augment movement of a body part by increased strength of material and/or compression.

In a bench pressing exercise, a weightlifter lies substantially flat on his back, with arms upraised. The weightlifter lowers a weight to the chest, and then pushes it vertically upward until the arms are straight. The tautness in a typical bench press shirt provides assistance and increased support for the underlying muscles, thereby allowing the weightlifter to lift more weight.

Weightlifting shirts typically provide a peak area of support from the bench press, referred to as a "support bubble." Typically, the lifter tries to push the weight upward in line with the support bubble of the bench press shirt. Shirt and lifter do not always have the perfect peak support area, so the lifter adjusts the bar path as much as possible to meet the peak of the shirt's support bubble. Moreover, the lifter can adjust the fitting position of the shirt to match the lifter's bar path. For example, the lifter could adjust the position of the neck band of a bench press shirt, or could adjust the position of the sleeves in relation to the lifter's deltoid muscles. Lifters can also employ both techniques of adjusting the bar path in combination with adjusting the fitting position of the shirt. Moreover, such shirts often do not have shoulder reinforcement that would provide adequate support for the lifter during elevation and descent of a weight through the bar path.

Other problems exist in prior art bench press shirts. During a bench press exercise, slack exists in the material of the shirt just below the lifter's arm from the front deltoid muscle. The slack material tightens as the bar is lowered. Additionally, bench press shirts may tear or shred at the shoulder seams and neck area where most the stress occurs. Thus, a problem that exists in the construction of prior art bench shirts is the lack of support across the shoulders of the wearer throughout the bar path of a bench press exercise.

Attempts have been made to provide a bench press shirt providing such support. For example, U.S. Pat. No. 5,383,235 relates to a shirt wherein the circumference and tightness of the area across the upper torso is less than that of the area around the waist. Other designs focus on the type of material and configuration of the compressible fabrics used across the upper chest. Such designs employ fabric or material across the shirt which fails to reinforce the front portion of the shoulder during the bench press exercise. Additionally, such designs fail to provide support to the shoulders which allows the weightlifter a full range of motion and support in shoulders and chest through the bar path. As a result, the lifter must expend additional energy to manually correct and stabilize the weight through the bar path. Therefore, a need exists for a support shirt which provides support across the shoulders and chest of the wearer through the bar path of a bench press exercise. A need also exists for a support shirt which provides support across the shoulders and chest of a wearer for a variety of sporting and work activities involving the lifting of weights or heavy objects.

BRIEF SUMMARY

Those needs are addressed by embodiments of the present invention that address the need for a support shirt which provides support across the shoulders and chest of the wearer, including sporting activities involving supporting weight such as climbing, rowing, and kayaking, and other activities. In one embodiment, the support shirt provides support to the wearer through the bar path of a bench press exercise. According to an embodiment of the present invention, the support shirt has a shirt body and a pair of shirt body sleeves positioned adjacent the upper shirt body. The shirt body has at least one section comprised of high tensile strength fabric extending across the upper torso of the wearer. The sleeves are attached to the shirt body at sleeve body holes. In some embodiments, each of the sleeves includes front and back sleeve portions, with the front and back sleeve portions being joined together.

During upward movement of the arms, a centerline extends across the chest and over the shoulder regions of the wearer. The centerline extends longitudinally across upper shirt body and front portions of the sleeves. Sleeve reinforcement regions extend at least a portion of the distance from the sleeve hole to an outer edge of the sleeve. The sleeve reinforcement regions extend substantially longitudinally along the path of the centerline along the sleeves and the upper portion of the shirt body. The sleeve reinforcement regions provide an increased area of support along the centerline, thereby stabilizing and providing support to the shoulders through an upward lifting motion. In one embodiment, the shirt body sleeves have at least one reinforcing section comprised of taut supporting fabric extending along the front portions of the sleeves.

In one embodiment, the sleeve reinforcement regions extend substantially from the sleeve holes to an outer portion of the sleeves along each sleeve portion. By "coupling seams," it is meant those lines along which two pieces of fabric are sewn together. The sleeve reinforcement regions comprise a taut length of material which, in some embodiments, may be secured to the coupling seams on the sleeve portions. Alternatively, the coupling seam may be located elsewhere on the sleeve portions to enable easier adjustment of the circumference of the sleeves to better fit a wearer. The sleeve reinforcement regions provide reinforcement proximate to the centerline along the front portions of the sleeves and across the upper portion of the shirt body. In some embodiments, the reinforcement regions overly or are coextensive with the coupling seams.

In alternate embodiments, the sleeve reinforcement regions comprise a waveform pattern. For example, in a first alternate embodiment, the sleeve reinforcement regions exist as a taut length of material located on coupling seams attached to the sleeve portions. The amplitude of the waveform pattern is measured from the centerline. The sleeve reinforcement regions provide reinforcement proximate to the centerline. Each sleeve portion has a front and back portion which are joined at a seam.

The structure and configuration of the sleeve reinforcement regions may vary. For example, the sleeve reinforcement regions may comprise a strip of material extending along the centerline with or without a coupling seam. Moreover, the sleeve reinforcement regions may also employ densely woven stitching along the centerline, with or without coupling seams. A strip of material may be separated by a coupling seam, and extend along the centerline. The purpose of the sleeve reinforcement regions is to provide an area of augmented support along the centerline, extending along the front portion of the sleeve portions.

Alternative embodiments of the support shirt may implement shirt sleeves which can be placed in a more downward tilted position, or less downward position, to accommodate different benching styles. Some lifters bench with a "flat back" on the bench which gives them a more vertical upward bar path in relation to their torso. Many lifters arch their back, which makes the bar path closer to that of a decline-bench bar path. The sleeve reinforcement regions on the front of the shirt can be placed in various positions to suit various bar path preferences, and various sleeve-tilt constructions.

The shirt body and sleeve portions are comprised of a fabric fitted to be taut when worn. As used herein, the term "fabric" is meant to include not only woven fibrous materials but also non-woven materials such as, for example, substantially continuous sheets of polymeric materials. The shirt body and sleeve members may be the same or of different material. Both the shirt body and sleeve members may be stretchable or non-stretchable material. The shirt body may or not have a back portion.

Accordingly, it is a feature of embodiments of the present invention to provide a support shirt with a supporting fabric across the upper torso of an individual.

It is a further feature of embodiments of the present invention to provide a support shirt with sleeve reinforcement regions providing support along a centerline extending across the chest and shoulder regions of the support shirt.

Other features and advantages of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
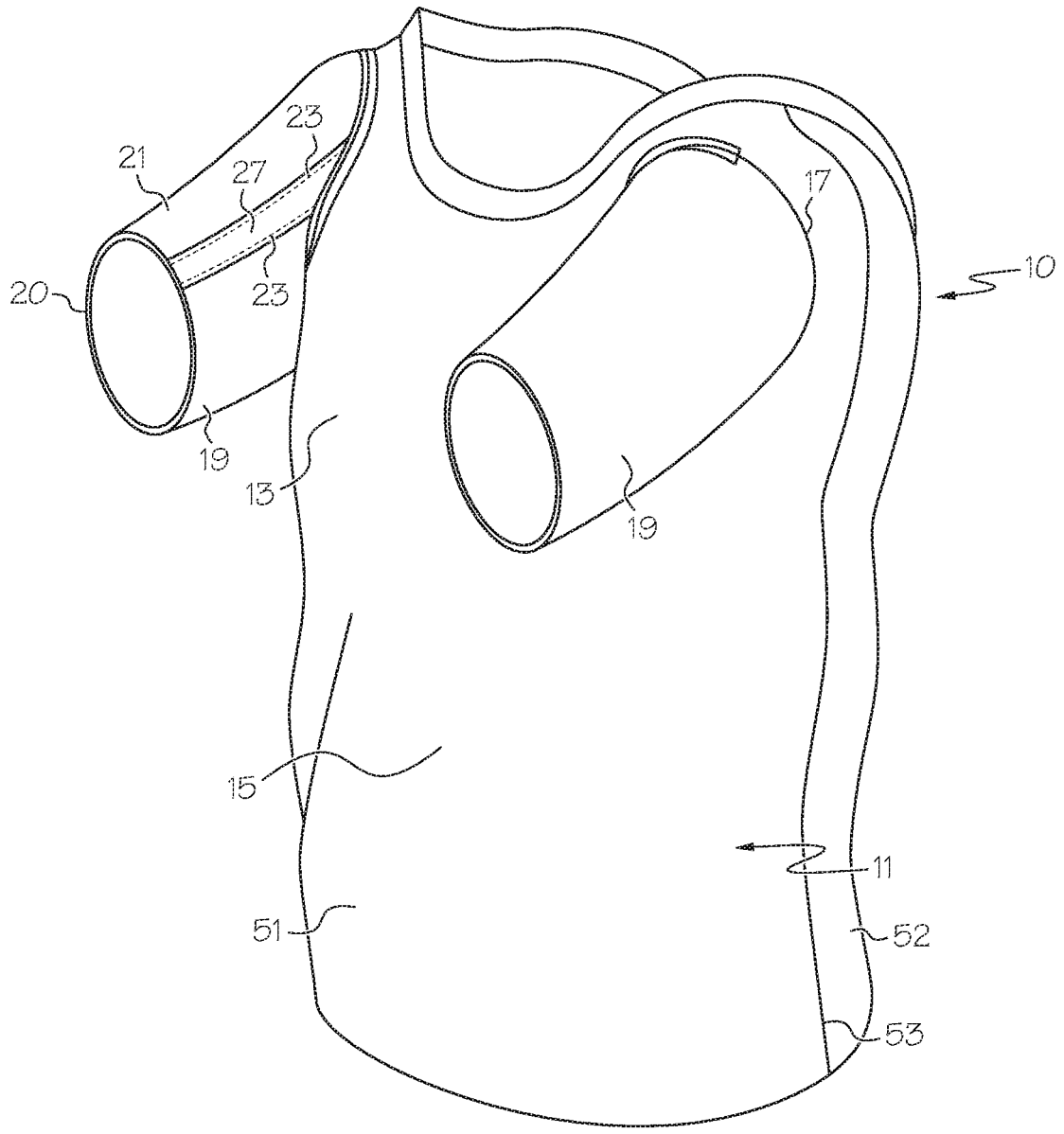
FIG. 1 depicts a perspective view of one embodiment of the support shirt of the present invention.

Referring initially to FIGS. 1-5, in an exemplary embodiment of the invention, a support shirt 10 comprises a shirt body 11 worn across the torso of an individual. The shirt body 11 comprises an upper shirt body 13 and lower shirt body 15, as shown, for example, in FIG. 1. Additionally, the shirt body 11 has a shirt front 51 and shirt back 52 joined at a body seam 53. The shirt body 11 is comprised of a supporting fabric extending across at least the upper shirt body 13. The support shirt is sized so that the supporting fabric is taut against the wearer's body when worn, providing support across the upper torso of the individual. The tautness of the fabric provides increased pressure exerted across the pectoralis major and serratus anterior muscles of the wearer. During an exercise such as a bench press, the shirt body 11 provides support as the bar is raised through a bar path 33 (see FIG. 15).

The fabric may be comprised of stretchable or non-stretchable material. Additionally, the fabric may be single ply or multi-ply and may be comprised of: canvas fabric; polyester; spandex type fabric; nylon fabric; organic cotton; or any kind of fabric that holds tautness. Further, the shirt body and sleeves may be comprised of polymeric material having a suitable thickness to provide the requisite strength. Shirt body sleeve holes 17 are positioned near the upper shirt body 13, corresponding with the area of traversal of the wearer's arms. The fabric comprising shirt body 11 has a tensile strength which will withstand the stresses of lifting from several hundred up to one thousand pounds of weight. Preferably, the fabric will have a tensile strength of at least about 90 pounds/int (psi) up to about 1000 psi, although fabrics having differing strengths may be used so long as the fabrics resist tearing and maintain their tautness during lifting. The type of fiber, the denier, and the weight of the fabric will all affect tensile strength.

Figure 2:
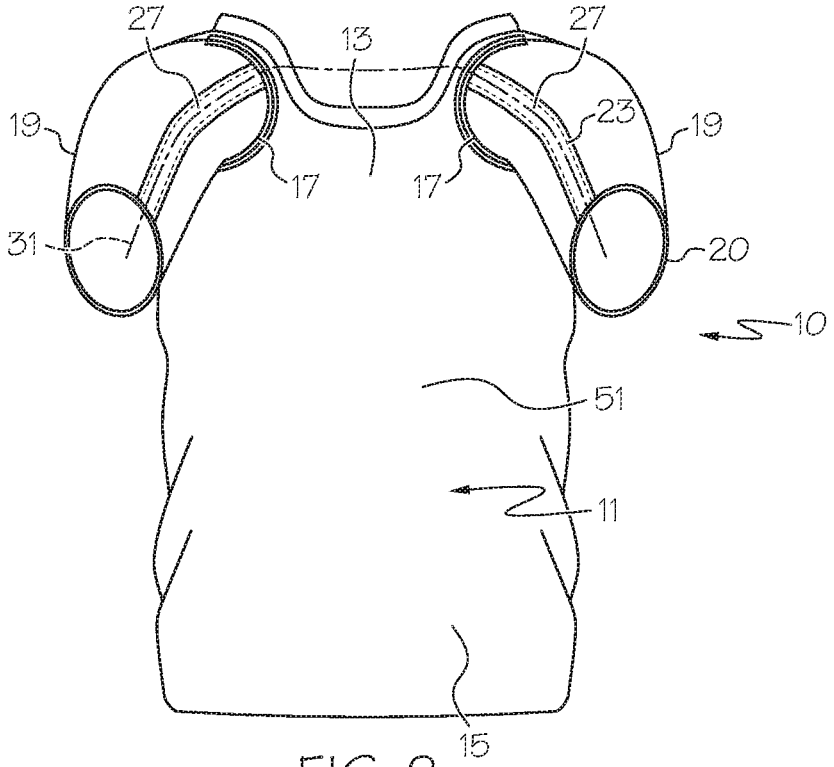
FIG. 2 depicts a front view of the support shirt of FIG. 1.

Sleeve portions 19, including front 21 and back 22 portions are attached to the shirt body 11 at the shirt body sleeve holes 17, as shown in FIGS. 1 and 2. The sleeve portions 19 provide compression across the shoulders of the wearer, corresponding with the anterior deltoid, coracobrachialis, scapulae fixer, biceps, and triceps of the wearer. The sleeve portions 19 are sized such that the fabric is taut when worn, providing support for the shoulders during lifting. The fabric may be comprised of stretchable or non-stretchable material. Additionally, the fabric may be single ply or multi-ply and may be comprised of: canvas fabric; polyester; spandex type fabric; nylon fabric; organic cotton; or any kind of fabric that holds tautness and has sufficient tensile strength.

Figure 3:
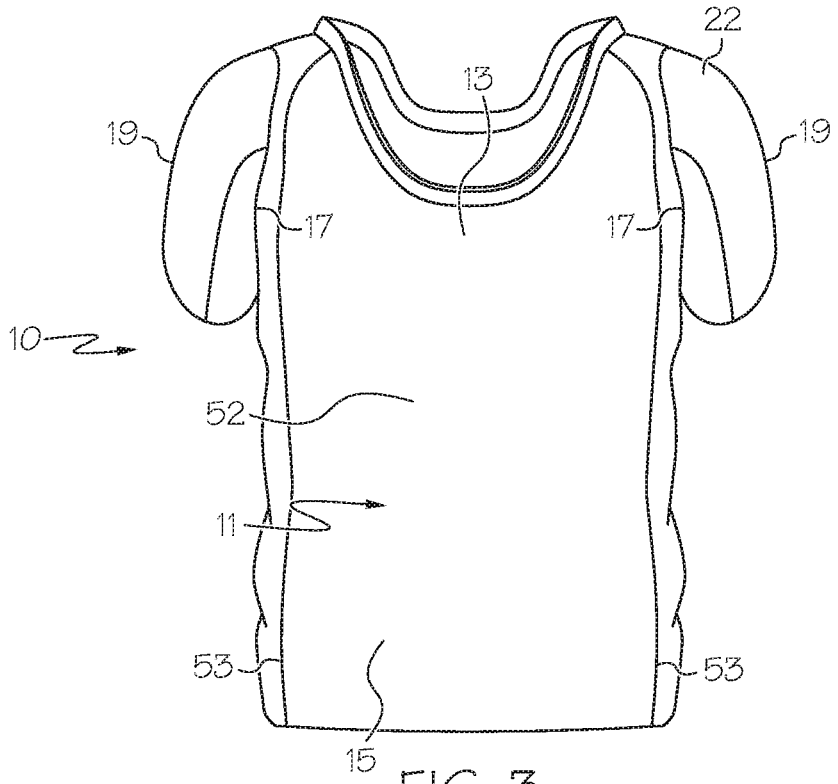
FIG. 3 depicts a back view of the support shirt of FIG. 1.

As best shown in FIGS. 2 and 3, the sleeve portions include a coupling seam 23 on the front of the sleeve and a second coupling seam 24 on the rear-facing portion of the sleeve. The coupling seams may extend all or a portion of the distance between the sleeve body hole and an outer edge of the sleeve. In this manner, second coupling seam 24 may be used to adjust the circumference of the sleeve to provide a customized fit for a wearer without the need to remove the reinforcing region on the front-facing side of the sleeve.

Figure 4:
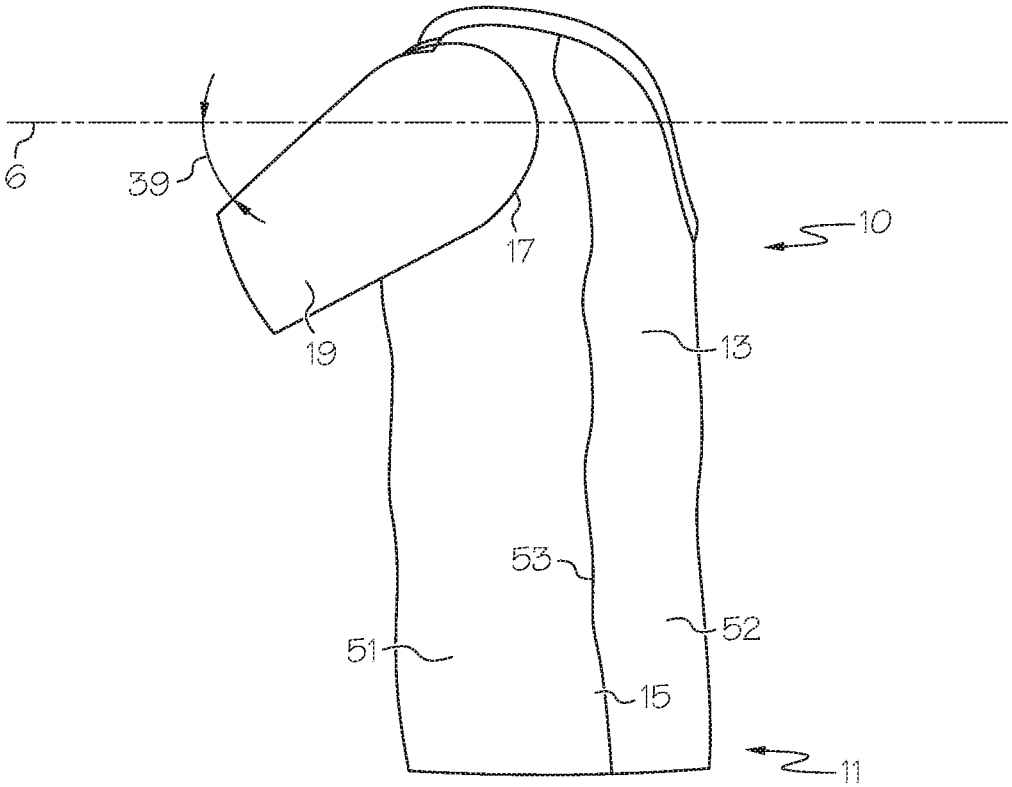
FIG. 4 depicts a side view of the support shirt of FIG. 1.

The sleeve portions 19 may be arranged in differing positions according to embodiments of the invention. For example, sleeve portions 19 can be placed in a more downward tilted position (see, e.g., FIG. 2), or less downward position (see, e.g., FIG. 1), to accommodate different bench pressing styles. Some lifters bench with a "flat back" on the bench which gives them a more vertical upward bar path 33 in relation to their torso. Many lifters arch their back, which makes the bar path 33 closer to that of a decline-bench press bar path where the lifter's knees are higher than his shoulders. In one embodiment, the sleeve portions 19 extend in a forward direction relative to a frontal plane 4 of the shirt body 11 and a downward direction relative to a transverse plane 6 of the shirt body 11 as shown in FIGS. 4 and 5.

Figure 5:
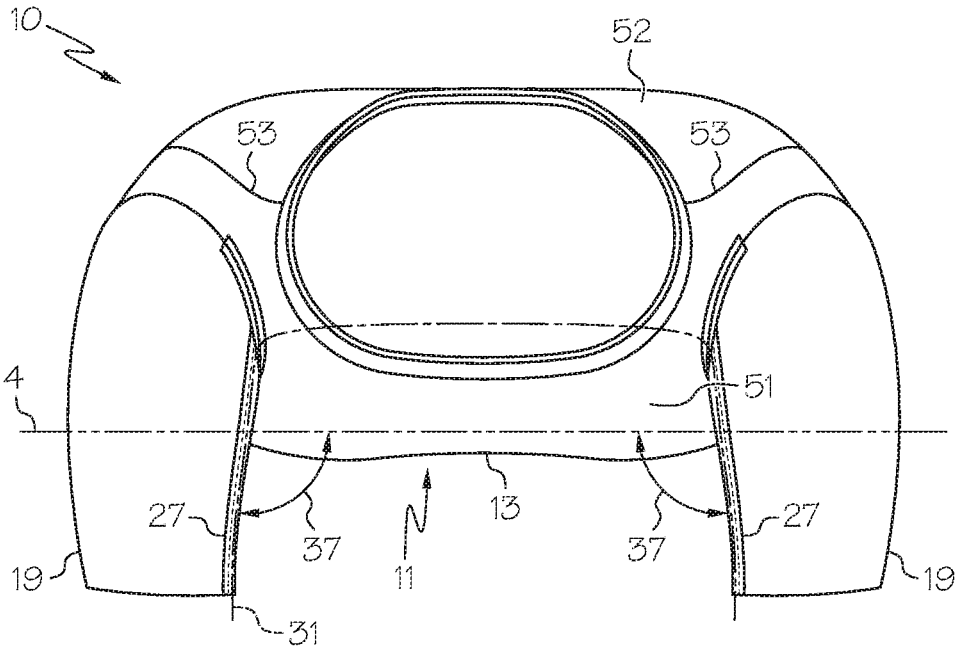
FIG. 5 depicts a top view of the support shirt of FIG. 1.
Figure 6:
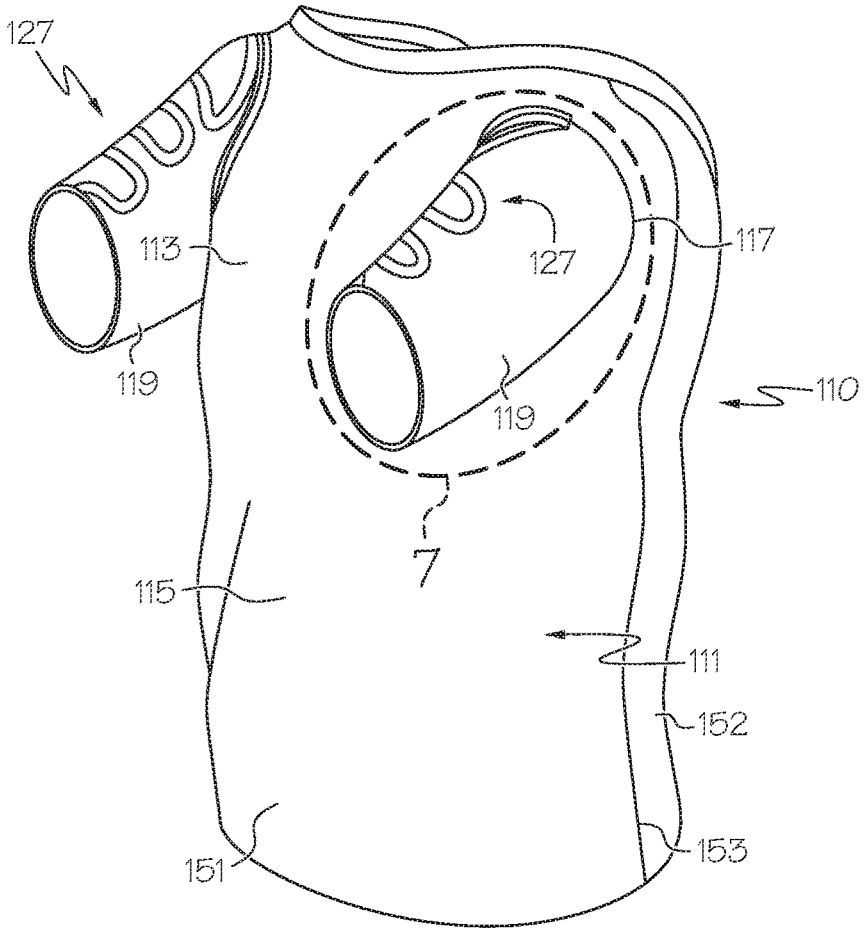
FIG. 6 depicts a perspective view of another embodiment of the support shirt of the present invention.
Figure 7:
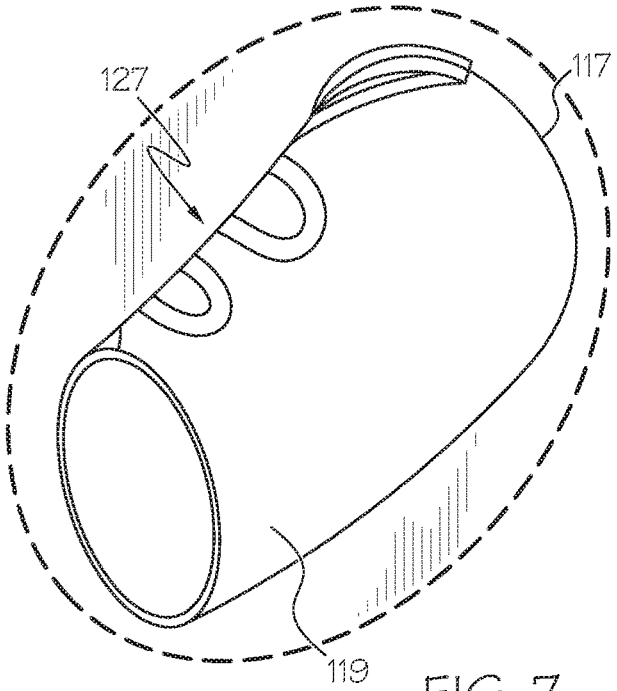
FIG. 7 depicts an enlarged, exploded view of a sleeve portion of the support shirt of FIG. 6.
Figure 8:
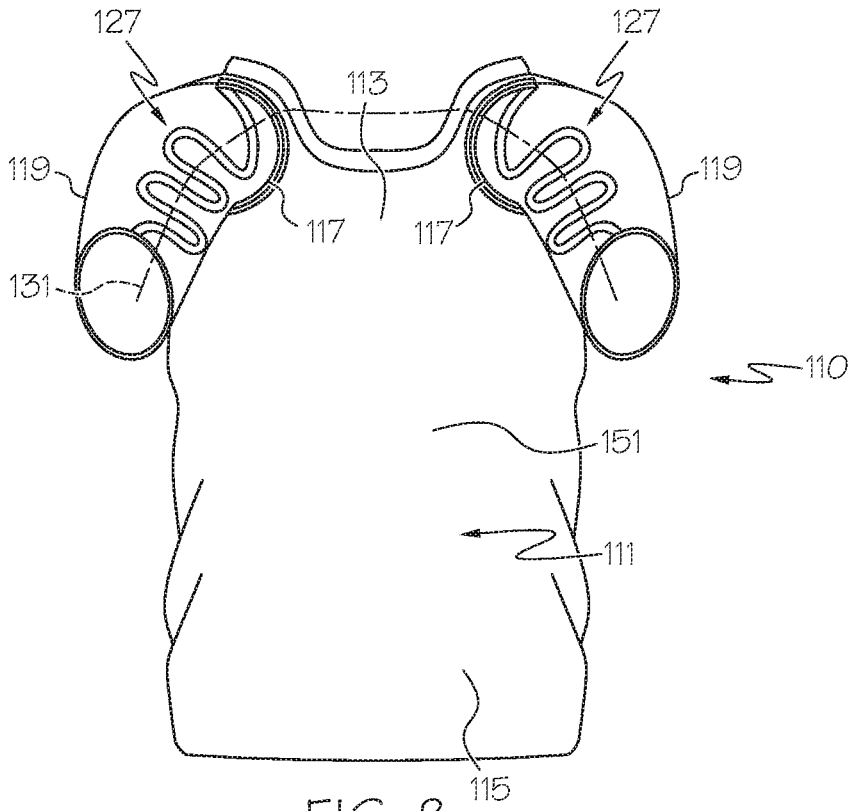
FIG. 8 depicts a front view of the support shirt of FIG. 6.
Figure 9:
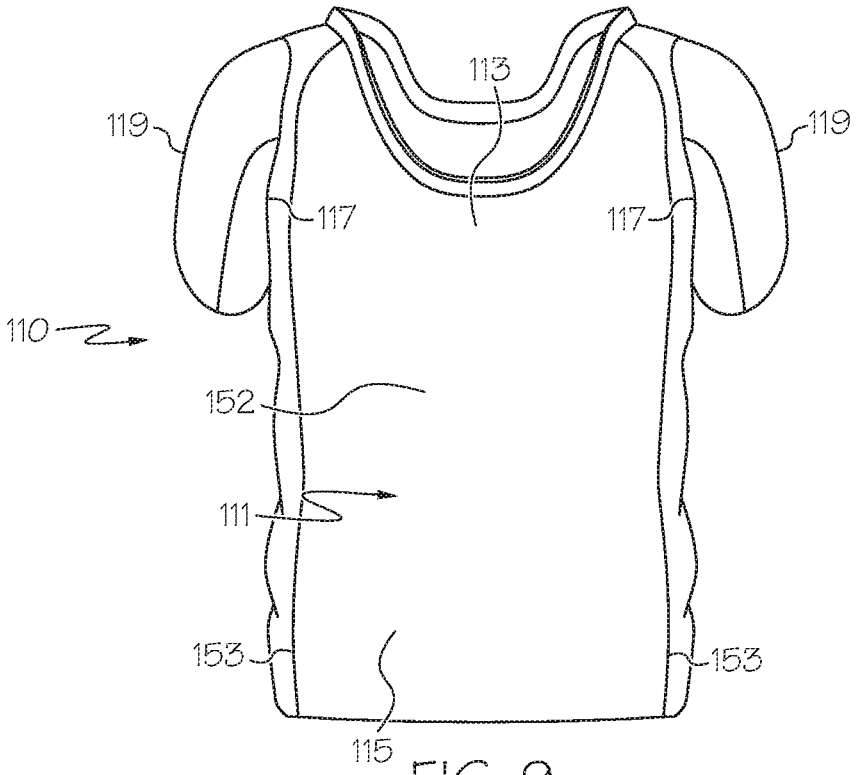
FIG. 9 depicts a back view of the support shirt of FIG. 6.

As shown in FIG. 5, in one embodiment sleeve portions 19 have a first central angle 37 of approximately 95° relative to the frontal plane 4. However, angle 37 may vary over a broad range depending on the desired use for the shirt. For example, angle 37 may vary between about 60° to about 180°. As shown in FIG. 4, in one embodiment sleeve portions 19 have a second central angle 39 of approximately 30° relative to the transverse plane 6 of the shirt body 11. However, angle 39 may vary over a broad range depending on the desired use for the shirt. For example, angle 39 may vary between an upwardly-directed angle of about 45° to a downwardly-directed angle of about 45° relative to transverse plane 6. In one embodiment, the fabric comprising the sleeve portions 19 has a tensile strength of at least about 90 psi, although fabrics of different tensile strengths may be used so long as the fabric has sufficient strength to resist tearing and maintain tautness during lifting.

Figure 14:
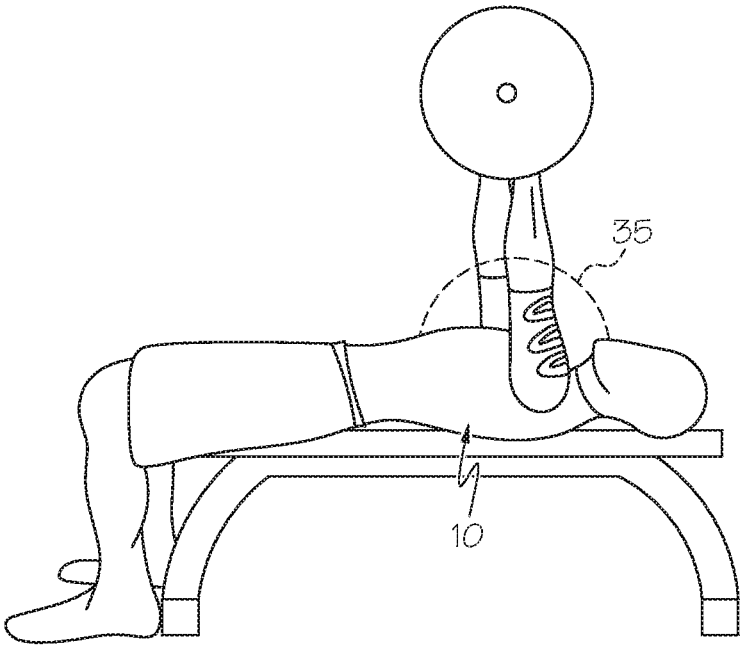
FIG. 14 depicts a side view of an individual wearing an embodiment of the support shirt of the present invention and shows the support bubble during a bench press exercise.

FIG. 14 illustrates a support bubble 35 during a bench press exercise, according to embodiments of the invention. The support bubble 35 represents an area of maximum support for the wearer of support shirt 10. During the bench press exercise, the lifter presses the bar generally vertically upward within the support bubble 35. Bench press shirts are designed to provide maximum support at the most natural point of pressing for the lifter, defined as the position where the lifter has pressed the weight to the position shown in FIG. 14, immediately beneath centerline 31. See, e.g., FIGS. 2 and 5.

Figure 12:
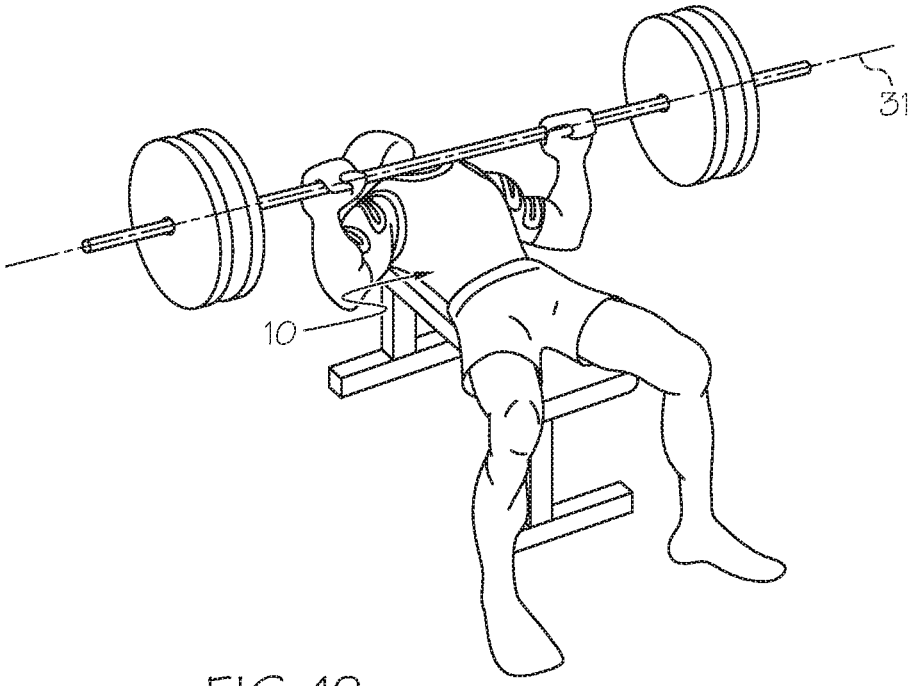
FIG. 12 depicts a perspective view of an individual wearing an embodiment of the support shirt of the present invention and indicates the location of the centerline during a bench press exercise.
Figure 13:
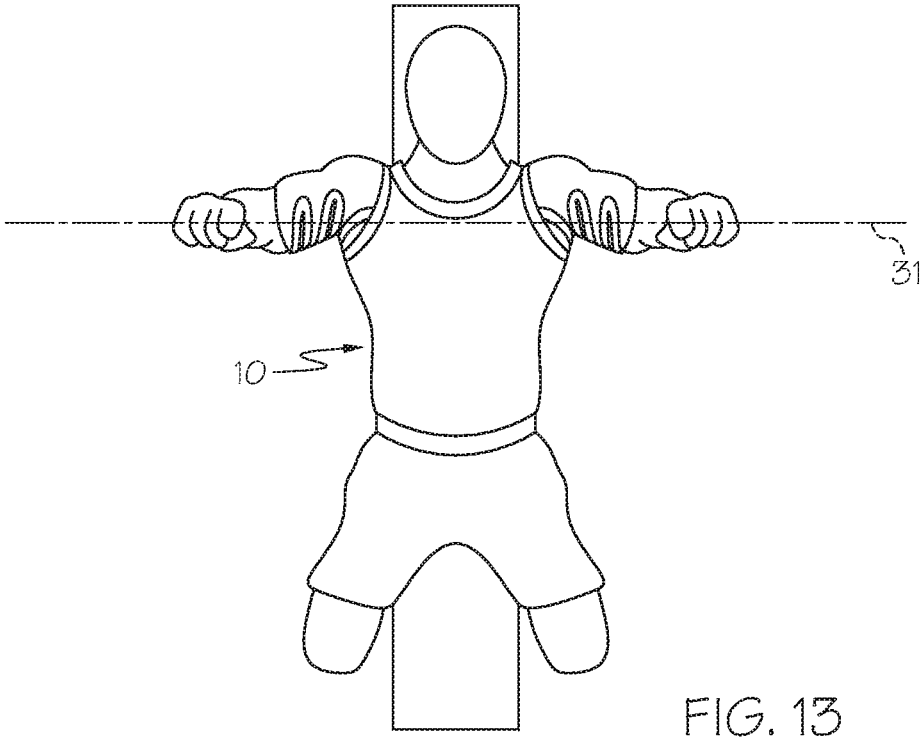
FIG. 13 depicts a top view of an individual wearing an embodiment of the support shirt of the present invention and indicates the location of the centerline during a bench press exercise.

The centerline 31 delineates the longitudinal axis of the weightlifting bar as shown in, for example, FIGS. 12 and 13. A vertical plane extending downwardly from centerline 31, within support bubble 35, corresponds to an area of maximum support for the support shirt 10. This, area of support extends along the upper shirt body 13 located slightly below the sleeve body holes 17 and corresponds with the longitudinal axis of the bar during the bench press exercise. The plane extending downwardly from centerline 31 extends across the upper torso of the individual and the frontal shoulder areas and forms a curvilinear axis on the support shirt as shown in FIG. 2. According to one embodiment, the plane extending downwardly from centerline 31 extends across the bench press shirt 10 and the lifter's body above the serratus anterior muscles and across the pectoralis major muscle.

Sleeve reinforcement regions 27 are located on each of the sleeve portions 19. The sleeve reinforcement regions 27 comprise a length of material, for example a rectangular strip of fabric, attached by, for example, stitching the fabric to the sleeve portions along coupling seams 23 as shown in FIGS. 1-5. In the embodiment shown, sleeve reinforcement regions 27 comprise strips of fabric that extend longitudinally from the shirt body sleeve holes 17 to the outer edge 20 of the sleeve portions 19. However, it is within the scope of embodiments of the present invention for the reinforcement regions 27 to extend for only a portion of this distance while still providing support across the shoulders and chest of a wearer. Typically, such fabric strips are from about one to about three inches in width. In one embodiment, sleeve reinforcement regions 27 comprise a taut piece of fabric stitched to support shirt 10. The areas comprising sleeve reinforcement regions 27 have greater tensile strength than that of shirt body 11 alone. Therefore, the sleeve reinforcement regions 27 provide greater support for the wearer's shoulders, biceps, and triceps during lifting, and assist the lifter during movement through the bar path 33.

Figure 15:
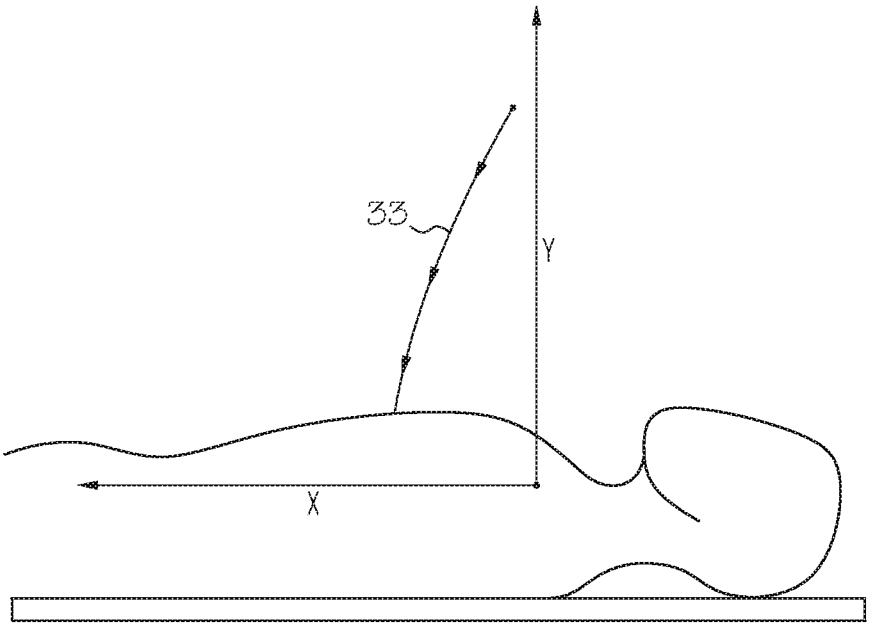
FIG. 15 depicts an example of a bar path during a bench press exercise.

In one embodiment, the areas comprising sleeve reinforcement regions 27 have a tensile strength of at least about 100 psi. However fabrics having different tensile strengths may be used so long as the effect of the reinforcing fabric is to provide the shirt with additional tensile strength in regions 27 greater than the fabric of shirt body 11 alone. As shown in FIG. 2 and FIG. 5, the sleeve reinforcement regions 27 are aligned such that they extend across the plane extending downwardly from centerline 31 during the bench press exercise. The sleeve reinforcement regions 27 form support areas for the lifter in the support bubble 35 through the bar path 33. An exemplary bar path is illustrated in FIG. 15.

The fabric and structure comprising the upper shirt body 13, lower shirt body 15, and sleeve portions of the support shirt 10 differ from conventional shirts or t-shirts. As distinguished from a conventional shirt or t-shirt, support shirt 10 has at least one area of increased support/strength, designed to augment movement of a body part by providing increased tensile strength of material and/or compression. Support shirt 10 utilizes such a supporting fabric with a greater tensile strength and thickness than ordinary shirts. Moreover, support shirt 10 utilizes fabric which provides compression and support across the chest area, thereby allowing support for athletic activities such as bench pressing exercises. The sleeve reinforcement regions 27 extend this area of support along the shoulders through the path of the plane extending downwardly from centerline 31, as defined herein. Therefore, the support shirt 10 naturally augments motion of the wearer's arms forward from the frontal plane of the wearer's body during athletic activities such as bench press exercises.

Although the present invention has been described in considerable detail with reference to certain embodiments thereof, other alternative embodiments are also within the scope of the invention. For example, FIGS. 6-11 illustrate one alternate embodiment. In the embodiment, support shirt 110 comprises a shirt body 111, upper shirt body 113, lower shirt body 115, shirt body sleeve holes 117, sleeve portions 119, and sleeve reinforcement regions 127 extending longitudinally about a centerline 131. Support shirt 110 also includes shirt front 151, shirt back 152, and shirt body seams 153. In this embodiment, the sleeve reinforcement regions extend in a sinusoidal waveform shape, with an amplitude measured from the centerline 131.

Typically, the sleeve reinforcement regions 127 are formed from high tensile strength fabric which is attached, for example by stitching, to the sleeve portions 119. The sleeve reinforcements may take the form of strips of fabric cut into waveform shape. There may be one or more layers of the fabric strips. The amplitude (distance from peak to centerline of wave) of the waveform pattern may range from about 0.25 to about 1.5 inches, while the repeat length may range from about 2 to about 4 inches.

Figure 10:
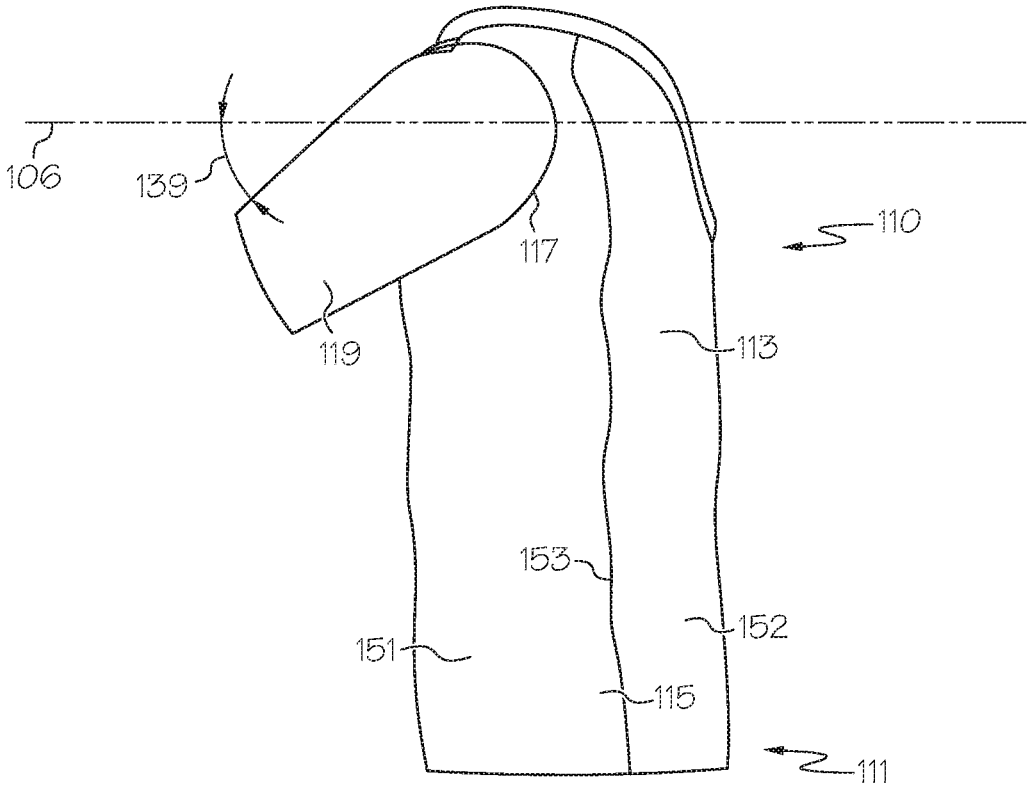
FIG. 10 depicts a side view of the support shirt of FIG. 6.
Figure 11:
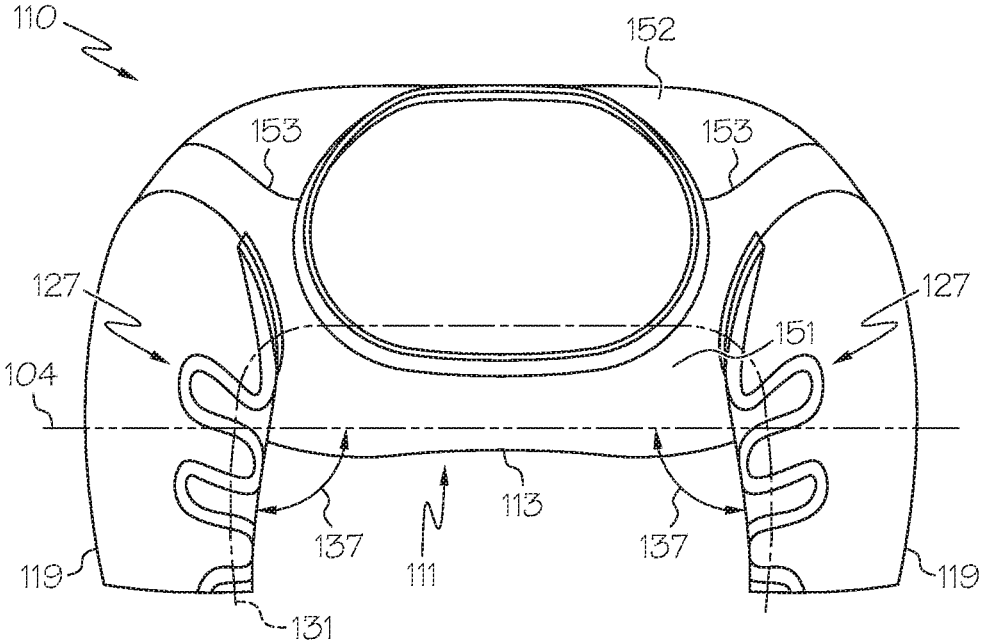
FIG. 11 depicts a top view of the support shirt of FIG. 6.

The sleeve portions 119 extend in an outward direction relative to a frontal plane 104 of the shirt body 111 and a downward direction relative to a transverse plane 106 of the shirt body 111 as shown in FIGS. 10 and 11. As shown in FIG. 11, in one embodiment sleeve portions 119 have a first central angle 137 of approximately 95° relative to the frontal plane 104, although, as previously described, such angle may vary broadly depending on the desired use for the shirt. As shown in FIG. 10, in one embodiment sleeve portions 119 have a second central angle 139 of approximately 30° relative to the transverse plane 106 of the shirt body 111, although as previously described, such angle may vary broadly depending on the desired use for the shirt. In the FIG. 10 embodiment, the sleeve portions 119 have a tensile strength sufficient to withstand the stresses of lifting from several hundred up to 1000 pounds. Preferably the sleeve portions have a tensile strength of at least about 90 psi, although differing strengths may be used. Preferably, the sleeve reinforcement regions 127 have a tensile strength of at least about 100 psi to provide additional support for the wearer.

Figure 16:
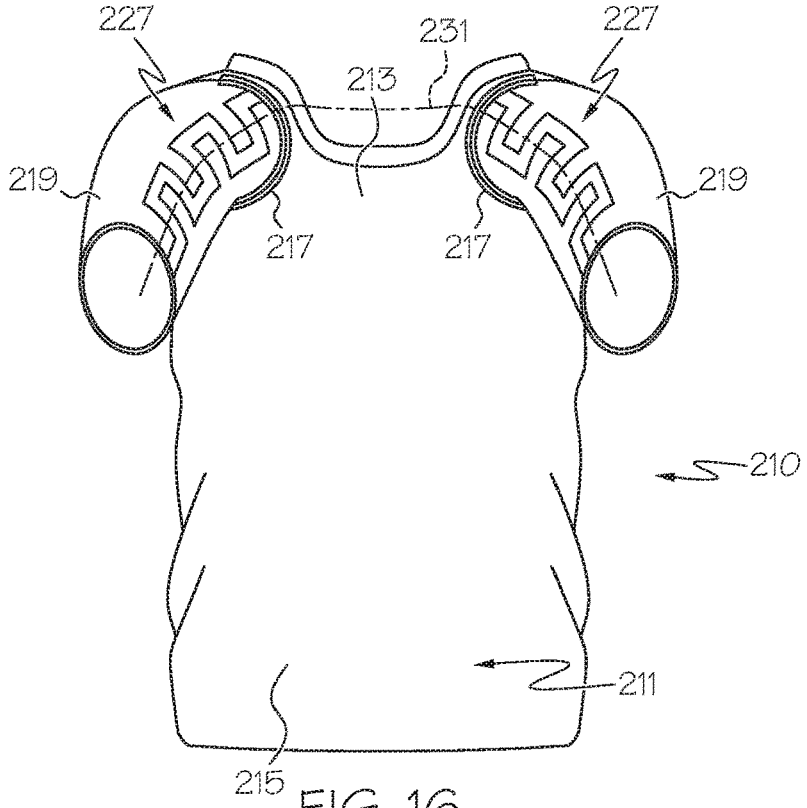
FIG. 16 depicts a front view of another embodiment of the support shirt of the present invention.

FIG. 16 shows an alternative embodiment of a support shirt 210. In this embodiment, the support shirt 210 comprises a shirt body 211, upper shirt body 213, lower shirt body 215, shirt body sleeve holes 217, sleeve portions 219, and sleeve reinforcement regions 227 extending longitudinally about a centerline 231. As shown, the sleeve reinforcement regions 227 extend in a square waveform pattern. As in the previous embodiments, sleeve reinforcement regions 227 are formed from high tensile strength fabric which is attached, for example by stitching, to the sleeve portions 219. The sleeve reinforcements may take the form of strips of fabric cut into a square waveform shape. There may be one or more layers of the fabric strips. The amplitude (distance from peak to centerline of wave) of the waveform pattern may range from about 0.25 to about 1.5 inches, while the repeat length may range from about 2 to about 4 inches. The sleeve reinforcement regions 227 have a tensile strength sufficient to provide additional support for the wearer.

Figure 17:
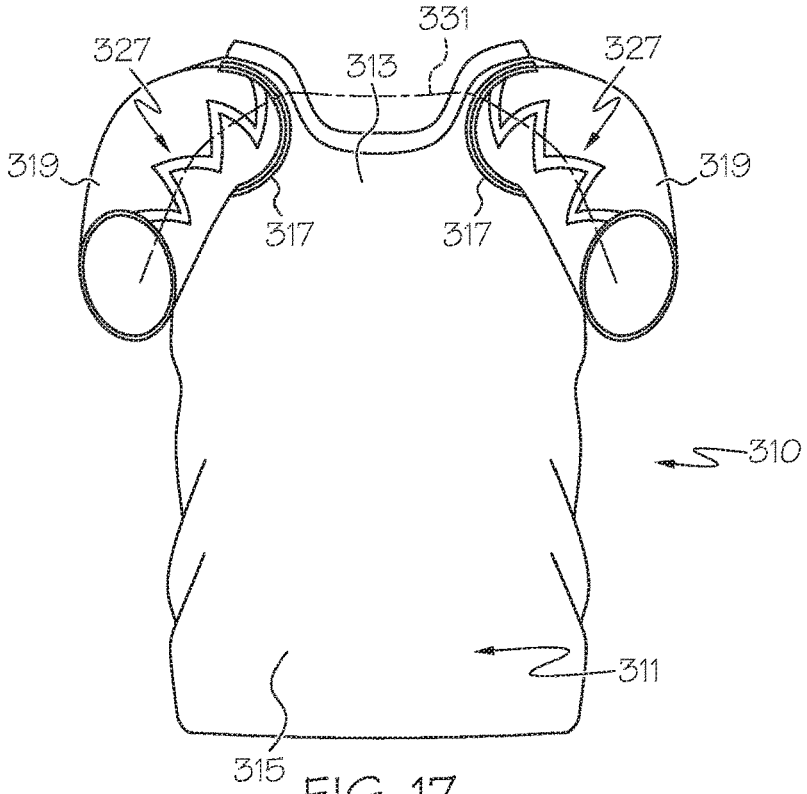
FIG. 17 depicts a front view of another embodiment of the support shirt of the present invention.

FIG. 17 shows yet another alternative embodiment of a support shirt 310. In this embodiment, the support shirt 310 comprises a shirt body 311, upper shirt body 313, lower shirt body 315, shirt body sleeve holes 317, sleeve portions 319, and sleeve reinforcement regions 327 extending longitudinally about a centerline 331. As shown, the sleeve reinforcement regions 327 extend in a triangular waveform pattern. As in the previous embodiments, sleeve reinforcement regions 327 are formed from high tensile strength fabric which is attached, for example by stitching, to the sleeve portions 319. The sleeve reinforcements may take the form of strips of fabric cut into a triangular waveform shape. There may be one or more layers of the fabric strips. The amplitude (vertical distance from peak to base) of the waveform pattern may range from about 0.25 to about 1.5 inches, while the repeat length may range from about 2 to about 4 inches. The sleeve reinforcement regions 327 have a tensile strength sufficient to provide additional support for the wearer.

Figure 18:
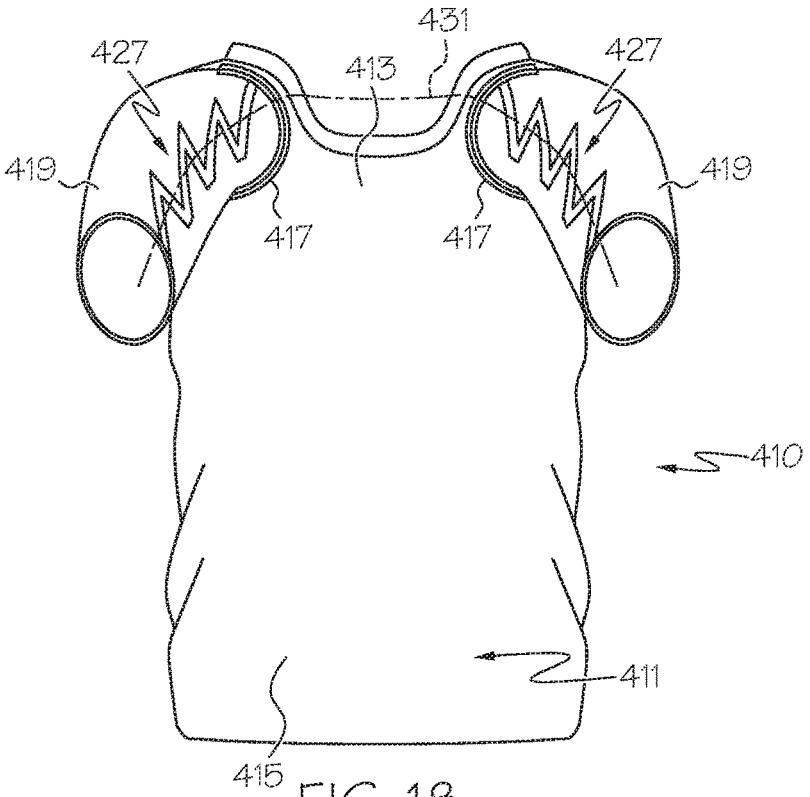
FIG. 18 depicts a front view of another embodiment of the support shirt of the present invention.

FIG. 18 shows yet another alternative embodiment of a support shirt 410. In this embodiment, the support shirt 410 comprises a shirt body 411, upper shirt body 413, lower shirt body 415, shirt body sleeve holes 417, sleeve portions 419, and sleeve reinforcement regions 427 extending longitudinally about a centerline 431. As shown, the sleeve reinforcement regions 427 extend in a sawtooth waveform pattern. As in the previous embodiments, sleeve reinforcement regions 427 are formed from high tensile strength fabric which is attached, for example by stitching, to the sleeve portions 419. The sleeve reinforcements may take the form of strips of fabric cut into a sawtooth waveform shape. There may be one or more layers of the fabric strips. The amplitude (vertical distance from peak to base) of the waveform pattern may range from about 0.25 to about 1.5 inches, while the repeat length may range from about 2 to about 4 inches. The sleeve reinforcement regions 427 have a tensile strength sufficient to provide additional support for the wearer.

Figure 19:
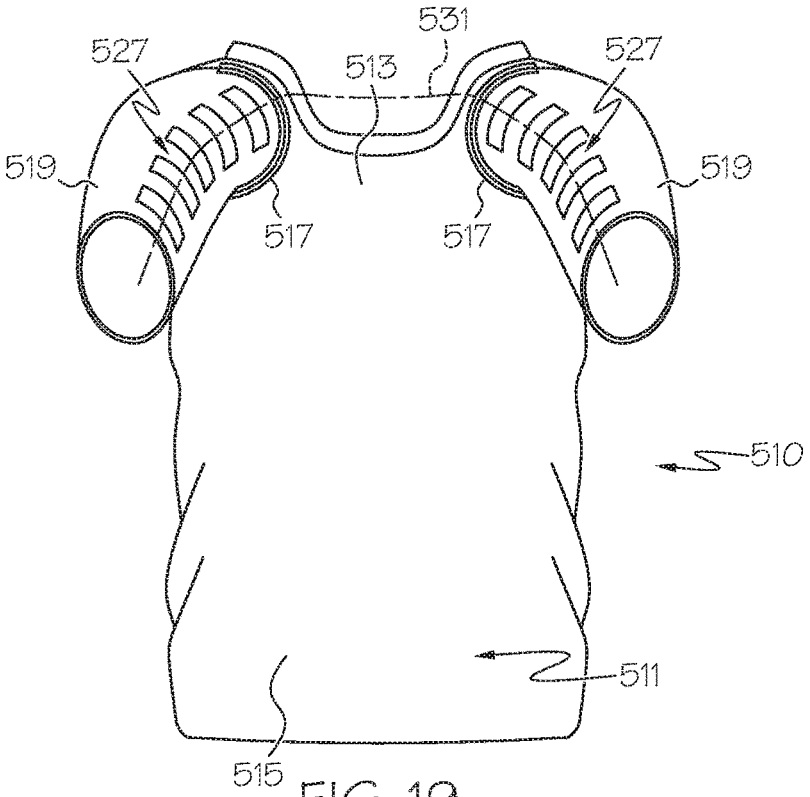
FIG. 19 depicts a front view of yet another embodiment of the support shirt of the present invention.

FIG. 19 shows yet another alternative embodiment of a support 510. In this embodiment, the support shirt 510 comprises a shirt body 511, upper shirt body 513, lower shirt body 515, shirt body sleeve holes 517, sleeve portions 519, and sleeve reinforcement regions 527 extending longitudinally about a centerline 531. As shown, the sleeve reinforcement regions 527 comprise individual, generally rectangular-shaped, fabric strips which extend approximately perpendicular to and on either side of centerline 531. As in the previous embodiments, sleeve reinforcement regions 527 are formed from high tensile strength fabric which is attached, for example by stitching, to the sleeve portions 519. The sleeve reinforcements may take the form of strips of fabric cut into generally rectangular shapes. There may be one or more layers of the fabric strips. The width of each strip may range from about 0.25 to about 1.5 inches, while the length may range from about 2 to about 4 inches. The strips may number between about two to about six, with five strips being shown. The sleeve reinforcement regions 527 have a tensile strength sufficient to provide additional support for the wearer.

The construction, material, and configuration of the elements described herein may vary. For example, the bench press shirt could also exist without a lower torso area, and/or without a shirt back.

Bench press shirts may be composed of numerous materials including synthetic and non-synthetic fibers. The support shirts of the embodiments herein provide support/and or compression during various athletic activities, and therefore have greater tensile strength than conventional shirts. For example, bench press shirts may or may not have elastic properties. For example, embodiments may utilize fabrics such as neoprene or spandex. Additionally, the support shirts may comprise stretch fabric including either two-way or four-way stretch.

The sleeve reinforcement regions may comprise a strip of material extending along the centerline with or without a coupling seam. Moreover, the sleeve reinforcement regions may also employ densely woven stitching along the centerline, with or without coupling seams. A strip of material may be separated by a coupling seam, and extend along the centerline. The sleeve reinforcement regions may or may not extend the entire distance from the sleeve body holes to the lower edge of the shirt. Therefore, the spirit and scope of the appended claims should not be limited to the descriptions of the preferred versions herein.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

Unless the meaning is clearly to the contrary, all ranges set forth herein are deemed to be inclusive of all values within the recited range as well as the endpoints.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A support shirt comprising:

a shirt body comprising a front panel and a back panel joined together at body seams;

a pair of sleeves attached to said front panel of said shirt body, said sleeves entirely spaced away from said back panel of said shirt body, said sleeves positioned adjacent to an upper portion of said shirt body, said sleeves each comprising a first end attached to said shirt body at a respective sleeve body hole located on said front panel of said shirt body, each of said sleeves further comprising an opposite second end; and a respective sleeve reinforcement region on each of said sleeves, each of said sleeve reinforcement regions comprising a length of fabric stitched to each of said sleeves and extending at least a portion of a distance from said respective sleeve body hole to an outer edge of said respective sleeve, said outer edge located at said respective second end, said sleeve reinforcement regions each extending along a centerline extending longitudinally across said respective sleeves and said upper portion of said shirt body.

2. The support shirt as claimed in claim 1, wherein said sleeve reinforcement regions provide said support shirt with additional tensile strength in said sleeve reinforcement regions greater than the tensile strength of said shirt body alone.

3. The support shirt as claimed in claim 1 in which each of said sleeves comprises a front portion and a back portion, said front portion and said back portion of each of said sleeves are joined together at coupling seams.

4. The support shirt as claimed in claim 3 in which each of said coupling seams extends at least a portion of a distance from a point where said respective front portion and said respective back portion of each of said sleeves are attached to said respective sleeve body holes to a point proximate said respective second end of said sleeves.

5. The support shirt as claimed in claim 1 in which said sleeve reinforcement regions each comprise coupling seams extending substantially from said respective sleeve body holes to said outer edges of said respective sleeves.

6. The support shirt as claimed in claim 5 in which said sleeve reinforcement regions each comprises a sinusoidal waveform pattern.

7. The support shirt as claimed in claim 5 in which said sleeve reinforcement regions each comprises a square waveform pattern.

8. The support shirt as claimed in claim 5 in which said sleeve reinforcement regions each comprises a sawtooth wave pattern.

9. The support shirt as claimed in claim 1 in which said shirt body and said sleeves comprise a single or multi-ply fabric comprised of canvas, polyester, spandex, nylon, or cotton.

10. The support shirt as claimed in claim 9 in which said single or multi-ply fabric has a tensile strength of at least 90 pounds per $in^2$ (psi).

11. The support shirt as claimed in claim 10 in which said single or multi-ply fabric has a tensile strength of at least 100 psi.

12. The support shirt as claimed in claim 1 in which said sleeves extend forward of a frontal plane extending across said shirt body at an angle of from 60° to 180°.

13. The support shirt as claimed in claim 12 in which said sleeves extend from a transverse plane extending substantially perpendicular to said frontal plane at an angle of between +45° and −45°.

14. The support shirt as claimed in claim 1 in which said sleeve reinforcement regions are configured to stabilize and provide support to shoulders of a wearer during an upward lifting motion.

15. The support shirt as claimed in claim 1 in which said sleeve reinforcement regions comprise more than one layer of fabric.

16. The support shirt as claimed in claim 1 in which said sleeve reinforcement regions have a tensile strength of at least 100 psi.

17. A support shirt comprising:

a shirt body comprising a front panel and a back panel joined together at body seams;

a pair of sleeves attached to said front panel of said shirt body, said sleeves entirely spaced away from said back panel of said shirt body, said sleeves positioned adjacent to an upper portion of said shirt body, each of said sleeves including a first end attached to said shirt body at a respective sleeve body hole located on said front panel of said shirt body, each of said sleeves further comprising a second end; and a respective sleeve reinforcement region on each of said sleeves, each of said sleeve reinforcement regions extending at least a portion of a distance from said respective sleeve body hole to an outer edge of said respective sleeve, said outer edge located at said respective second end, said sleeve reinforcement regions each comprising one or more layers of fabric stitched to said respective sleeve at a respective coupling seam, said sleeve reinforcement regions each extending substantially along a centerline extending longitudinally across said respective sleeves and said upper portion of said shirt body.

18. A support shirt comprising:

a shirt body comprising a front panel and a back panel joined together at body seams;

a pair of sleeves comprising a first fabric attached to said front panel of said shirt body, said sleeves entirely spaced away from said back panel of said shirt body, and said sleeves positioned adjacent to an upper portion of said shirt body, said sleeves each having an interior surface and an exterior surface, said sleeves each comprising a first end attached to said shirt body at a respective sleeve body hole located on said front panel of said shirt body, each of said sleeves further comprising a second end; and a respective sleeve reinforcement region on each of said sleeves, each of said sleeve reinforcement region comprising a second fabric stitched to said respective sleeve beginning at a respective one of said sleeve body holes and extending at least a portion of a distance from said respective sleeve body hole to an outer edge of said respective sleeve, said outer edge located at said respective second end, said sleeve reinforcement regions extending substantially along a centerline extending longitudinally across said respective sleeves and said upper portion of said shirt body, said second fabric of each sleeve reinforcement region overlying said first fabric of said respective sleeve on at least one of said interior surface and said exterior surface of said respective sleeve.

19. The support shirt of claim 18, wherein said first fabric and said second fabric are formed of a same type of material.

20. The support shirt of claim 18, wherein said first fabric and said second fabric are formed of different materials.

* * * * *